US009835304B2

(12) United States Patent
Wu

(10) Patent No.: US 9,835,304 B2
(45) Date of Patent: Dec. 5, 2017

(54) LAMP

(71) Applicant: COPLUS INC., New Taipei (TW)

(72) Inventor: Jacob Wu, Tainan (TW)

(73) Assignee: COPLUS INC., New Taipei (TW)

( * ) Notice: Subject to any disclaimer, the term of this patent is extended or adjusted under 35 U.S.C. 154(b) by 8 days.

(21) Appl. No.: 15/093,262

(22) Filed: Apr. 7, 2016

(65) Prior Publication Data

US 2016/0305625 A1 Oct. 20, 2016

(30) Foreign Application Priority Data

Apr. 14, 2015 (TW) ..... 104205554 U

(51) Int. Cl.
*F21V 1/00* (2006.01)
*F21S 8/10* (2006.01)

(52) U.S. Cl.
CPC ..... *F21S 48/1159* (2013.01); *F21S 48/1109* (2013.01); *F21S 48/328* (2013.01)

(58) Field of Classification Search
CPC ... F21S 48/1109; F21S 48/1159; F21S 48/328
USPC ..... 362/509
See application file for complete search history.

(56) References Cited

U.S. PATENT DOCUMENTS 9,651,214 B2 * 5/2017 Lee ..... F21S 48/328

FOREIGN PATENT DOCUMENTS

WO WO 2015091462 A1 * 6/2015 ..... F21S 48/1159

* cited by examiner

*Primary Examiner* — Seung Lee
(74) *Attorney, Agent, or Firm* — DLA Piper LLP (US)

(57) ABSTRACT

A lamp includes a lamp base unit, a light emitting unit, and a light shape piece. The lamp base unit includes a base seat, a first seat extending from the base seat, and a second seat extending from the first seat. The light emitting unit includes an LED high beam light module disposed on one of the first seat and the second seat, and an LED low beam light module disposed on the other one of the first seat and the second seat and having a light irradiation direction different from that of the LED high beam light module. The light shape piece is disposed on one of the first seat and the second seat for refracting light emitted from a corresponding one of the LED high beam light module and the LED low beam light module to form a light shape having a cut-off line.

3 Claims, 4 Drawing Sheets

LAMP

CROSS-REFERENCE TO RELATED APPLICATION

This application claims priority of Taiwanese Patent Application No. 104205554, filed on 14 Apr. 2015.

FIELD

The disclosure relates to a lamp, and more particularly to a vehicle lamp.

BACKGROUND

Referring to FIG. 1, a conventional H4-type halogen lamp 1 is installed in a reflecting cover (not shown). The conventional H4-type halogen lamp 1 includes abase seat 11, a transparent cover 12 disposed in front of the base seat 11 and defining an isolated space 121, and a light emitting unit 13 disposed in the isolated space 121. The light emitting unit 13 includes a low beam light module 131 formed by a tungsten filament, a light shield 133 covering a portion of the low beam light module 131, and a high beam light module 132 formed by a tungsten filament.

The low beam light module 131 and the high beam light module 132 are spaced apart from each other in a front-rear direction, and each of the low beam light module 131 and the high beam light module 132 can be individually switched on. Moreover, with the reflecting cover and the light shield 133, each of the low beam light module 131 and the high beam light module 132 can emit light that has specific shape. However, the emitting unit 13 made of tungsten filament may easily burn out due to high temperature after long term use, thereby resulting in a high power consumption and a short service life of the conventional lamp 1.

SUMMARY

Therefore, an object of the disclosure is to provide a lamp that can alleviate at least one of the drawbacks of the prior art.

According to the disclosure, the lamp includes a lamp base unit and a light emitting unit. The lamp base unit includes a base seat, a first seat extending forwardly from the base seat, and a second seat extending forwardly from the first seat. The light emitting unit includes an LED (light emitting diode) high beam light module disposed on one of the first seat and the second seat, and a LED low beam light module disposed on the other one of the first seat and the second seat, and that has a light irradiation direction different from that of the LED high beam light module. The lamp further includes a light shape piece disposed on one of the first seat and the second seat for refracting light that is emitted from a corresponding one of the LED high beam light module and the LED low beam light module to form a light shape having a cut-off line.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
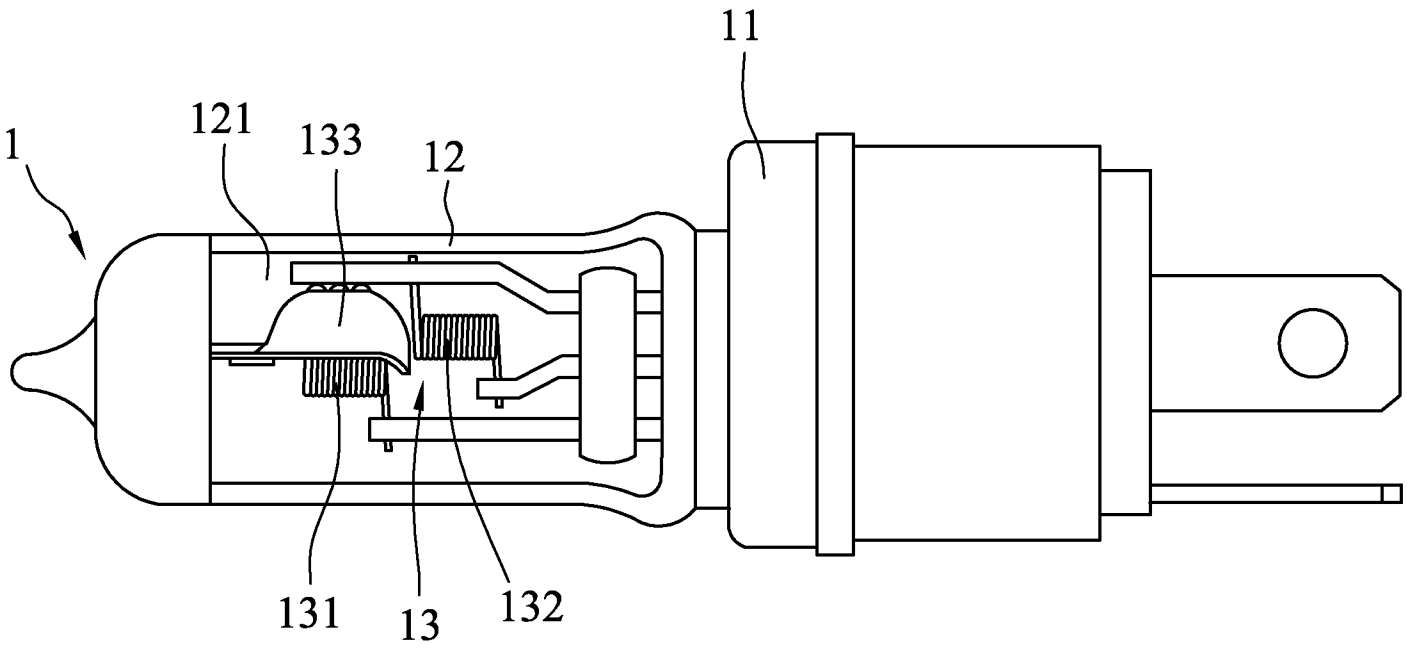
FIG.1 PRIOR ART
FIG. 1 is a side view illustrating a conventional H4-type halogen lamp.
Figure 2:
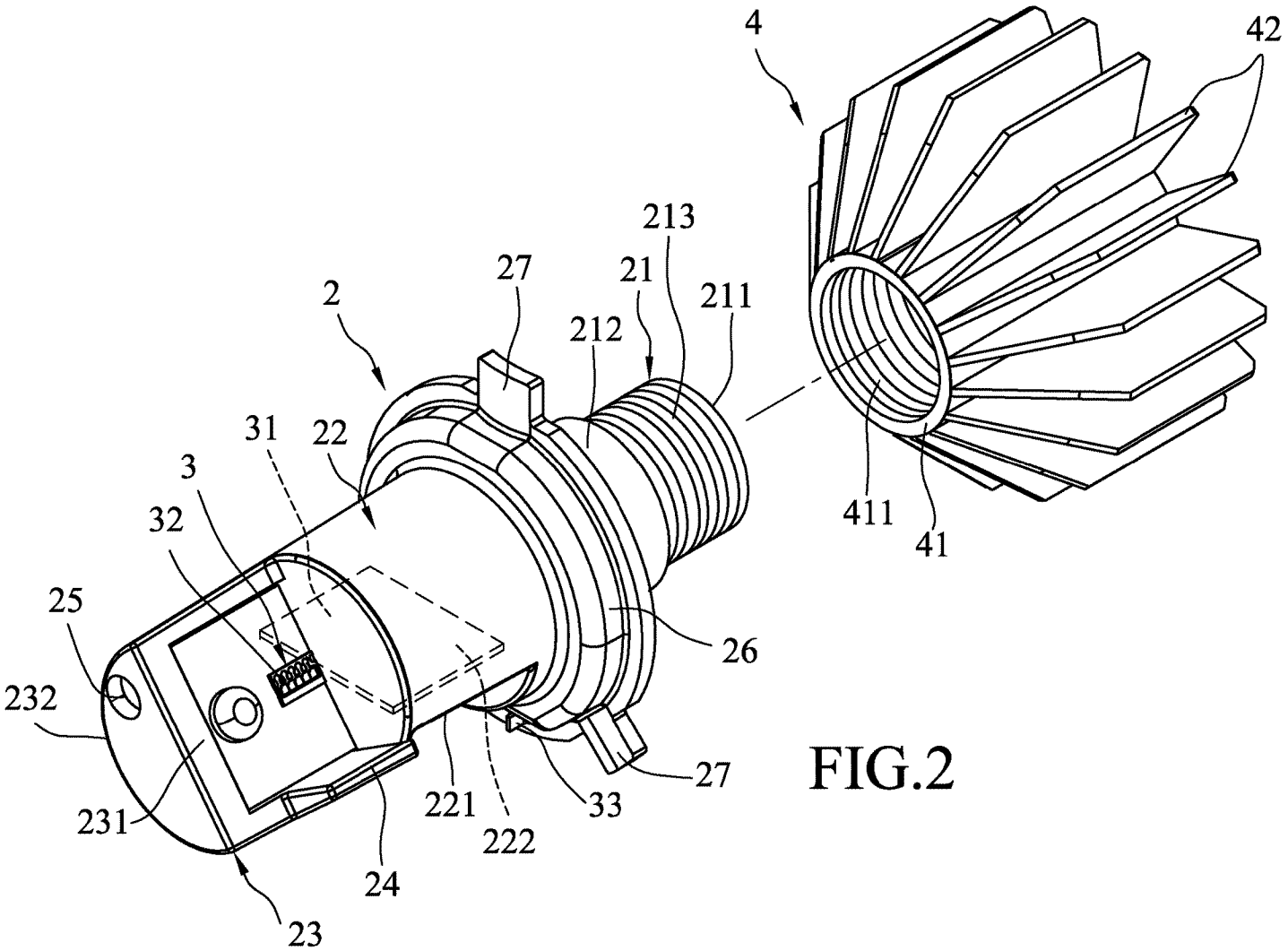
FIG. 2 is a partly exploded perspective view illustrating an embodiment of a lamp of the disclosure.
Figure 3:
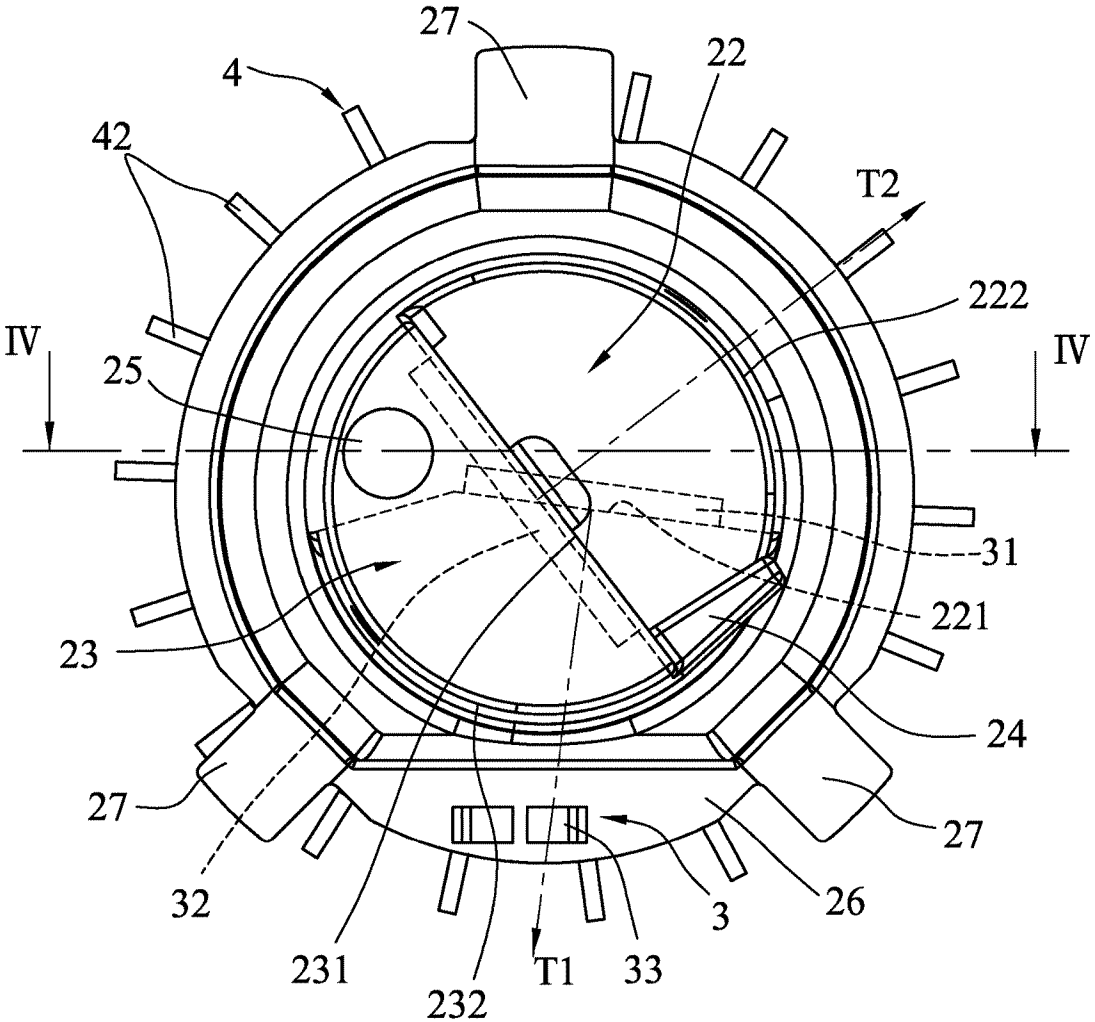
FIG. 3 is a front view of the embodiment.
Figure 4:
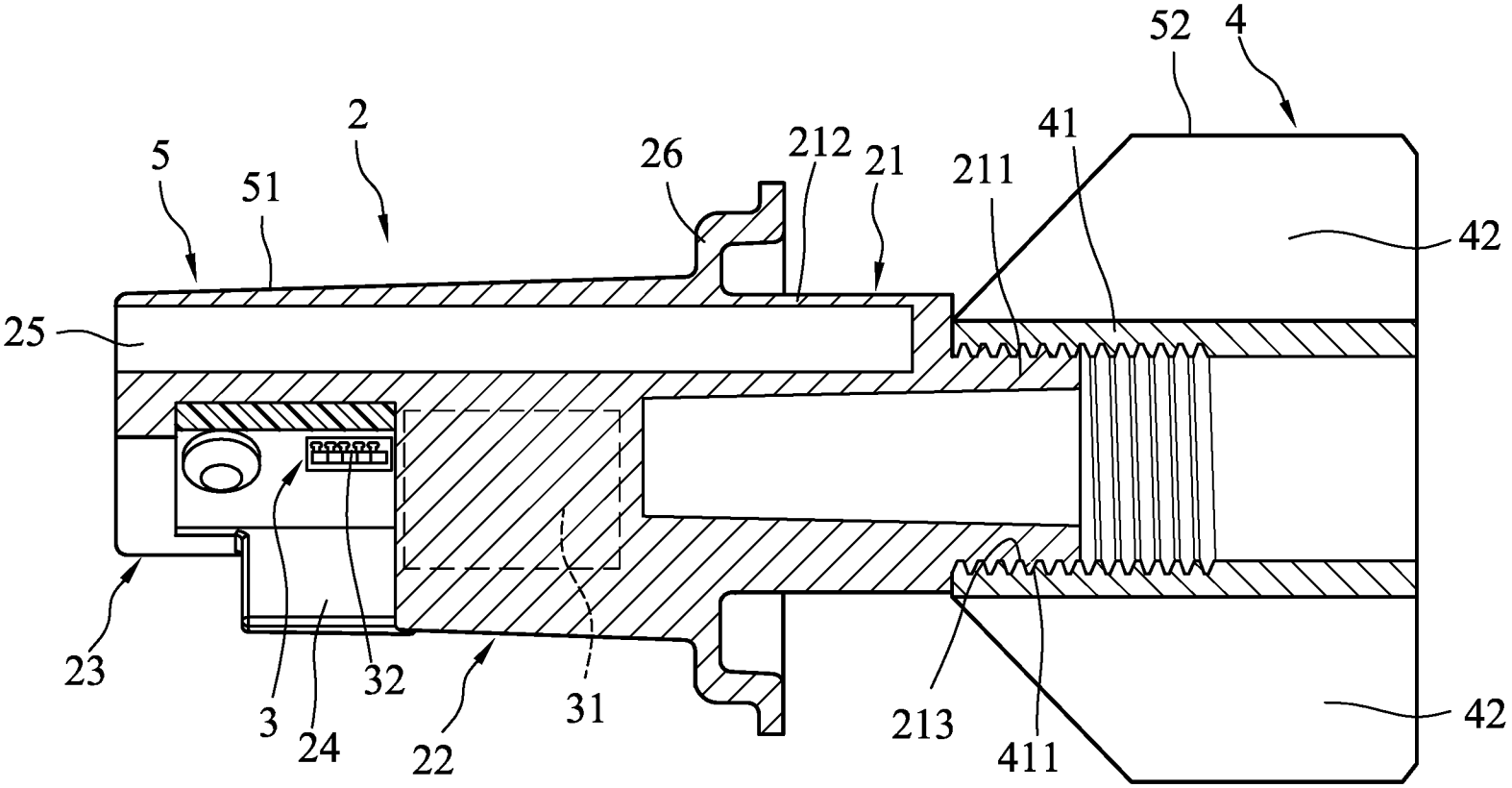
FIG. 4 is a sectional view of the embodiment taken along line IV-IV in FIG. 3.

Referring to FIGS. 2 to 4, an embodiment of a lamp according to the present disclosure is adapted to be installed in a reflecting cover (not shown), such that light emitted from the lamp is reflected by the reflecting cover to travel forwardly. The lamp includes a lamp base unit 2, a light emitting unit 3, a heat-dissipating unit 4, and a light shape piece 24.

The lamp base unit 2 is made of a thermal conductive material, such as aluminum, copper, ceramic, and so on, and is formed as one piece. The lamp base unit 2 includes a base seat 21, a first seat 22 extending forwardly from the base seat 21, a second seat 23 extending forwardly from the first seat 22, and a heat-conducting pipe 25 extending from the base seat 21 to the second seat 23 through the first seat 22.

The base seat 21 is tubular, and has a coupling portion 211 formed at a rear end thereof, and a connecting portion 212 formed at a front end thereof and interconnecting the first seat 22 and the coupling portion 211. The coupling portion 211 has an outer diameter smaller than that of the connecting portion 212, and is formed with an external thread 213.

Each of the first seat 22 and the second seat 23 has a semi-cylindrical shape. The first seat 22 has a first mounting surface 221 facing toward a first direction (T1), and a first heat-dissipating surface 222 opposite to the first mounting surface 221. The second seat 23 has a second mounting surface 231 facing toward a second direction (T2) (i.e., the second mounting surface 231 has an orientation different from that of the first mounting surface 221), and a second heat-dissipating surface 232 opposite to the second mounting surface 231. The first direction (T1) deviates from the second direction (T2) by an angle ranging between 90 and 180 degrees. In this embodiment, the angle between the first direction (T1) and the second direction (T2) is 135 degrees. The first heat-dissipating surface 222 and the second heat-dissipating surface 232 are both curved surfaces for obtaining as large a heat-dissipating area as possible.

The light shape piece 24 is disposed on the other one of the first seat 22 and the second seat 23. In this embodiment, the light shape piece 24 is disposed on a lateral end of the second mounting surface 231 of the second seat 23. The shape, length, angle and position of the light shape piece 24 may vary as required in different embodiments.

In this embodiment, the heat-conducting pipe 25 extends through a side portion of the first seat 22 and a side portion of the second seat 23 into the connecting portion 212 of the base seat 21. The heat-conducting pipe 25 is made of a material having a good thermal-conductivity, and receives a heat-conducting liquid therein. Since the structure of the heat-conducting pipe 25 and the way the heat-conducting pipe 25 conducts heat is known in the art, further details on the same are omitted herein for the sake of brevity.

In this embodiment, the lamp base unit 2 further includes a ring member 26 protruding outwardly from the connecting portion 212 of the base seat 21, and three angularly spaced-apart engaging blocks 27 protruding outwardly from the ring member 26. The ring member 26, the engaging blocks 27, and the base seat 21 are formed as one piece. It should be noted that, in other embodiments, the ring member 26 and the engaging blocks 27 may be separately made and then assembled together with the base seat 21, and the number of the engaging blocks 27 may vary.

In this embodiment, the emitting unit 3 includes an LED high beam light module 31 mounted on the first mounting surface 221 of the first seat 22, an LED low beam light module 32 mounted on the second mounting surface 121 of the second seat 23, and a power supply connector 33 disposed on the ring member 26 of the lamp base unit 2. The LED high beam light module 31 emits light in the first direction (T1), and the LED low beam light module 32 emits light in the second direction (T2) (i.e., the LED low beam light module 32 has a light irradiation direction different from that of the LED high beam light module 31). Each of the LED high beam light module 31 and the LED low beam light module 32 has a plurality of LEDs. The power supply connector 33 is electrically connected to the LED high beam light module 31 and the LED low beam light module 32 for connecting them to an external power supply (e.g. power supply for vehicles) can be transmitted to the LED high beam light module 31 and the LED low beam light module 32. Since the feature of the disclosure does not reside in the connection and the control circuit among the LED high and low beam light modules 31, 32 and the power supply connector 33, further details of the same are omitted herein for the sake of brevity.

The heat-dissipating unit 4 is made of a thermal conductive material such as aluminum, copper, ceramic, and so on, is formed as one piece, and is removably connected to the base seat 21 of the lamp base unit 2. The heat-dissipating unit 4 has a hollow coupling seat 41 disposed behind the ring member 26 and having an outer surface, and a plurality of angularly spaced-apart heat-dissipating fins 42 provided on the outer surface of the coupling seat 41. The coupling seat 41 has an internal thread 411 threadedly connected to the external thread 213 of the coupling portion 211. While in this embodiment, the coupling seat 41 is exemplified to be coupled removably and threadedly to the coupling portion 211 of the base seat 21, the connection between the coupling seat 41 and the coupling portion 211 is not limited thereto. For example, in other embodiments, the external and internal threads 213, 411 may be omitted, and the coupling portion 211 may be inserted into the coupling seat 41 with at least one screw being used to fix threadedly the coupling portion 211 and the coupling seat 41 together.

When assembling the lamp, the power supply connector 33 is first connected electrically to the external power supply. Then, the ring member 26 and the engaging blocks 27 are mounted to the reflecting cover, and the coupling seat 41 is connected threadedly to the coupling portion 211 of the base seat 21, so that the reflecting cover is clamped between the ring member 26 and the heat-dissipating unit 4.

In use, since the LED high beam light module 31 is disposed closer to the reflecting cover than the LED low beam light module 32, the light emitted from the LED high beam light module 31 can be focused and projected to a place that is farther than the light emitted from the LED low beam light module 32. After being refracted by the light shape piece 24, the light emitted from the LED low beam light module 32 forms a light shape that has a cut-off line, that is in conformity with the law, and that can avoid glaring at opposing cars.

Moreover, the light emitted from the LED high beam light module 31 and the light emitted from the LED low beam light module 32 respectively emit to different portions of the reflecting cover. The portions of the reflecting cover have different shapes to ensure required light shapes of the high-beam light and the low-beam light. Therefore, the angle between the first and second directions (T1, T2) (i.e., the angle between the orientations of the first and second mounting surfaces 221, 231) is predetermined according to the shapes of the different portions of the reflecting cover.

In this embodiment, when using the lamp, the LED high beam light module 31 causes waste heat that is transmitted to the base seat 21 through the first seat 22, and the LED low beam light module 32 causes waste heat that is transmitted to the base seat 21 through the second seat 23. With the heat-conducting pipe 25, the waste heat is rapidly transmitted to the base seat 21. Then the waste heat is transmitted to the heat-dissipating fins 42 through the coupling seat 41, and eventually to external environment, thereby resulting in a good heat-dissipating efficiency and a long service life of the LED high beam light module 31 and the LED low beam light module 32.

In addition, in this embodiment, the lamp further includes an anti-reflection unit 5 so that the light reflected from the reflecting cover can avoid being reflected again by the lamp base unit 2. The anti-reflection unit 5 has a first anti-reflection layer 51 coated on an outer surface of the lamp base unit 2, and a second anti-reflection layer 52 coated on an outer surface of the heat-dissipating unit 4. Since the feature of the disclosure does not reside in the material of the first anti-reflection layer 51 and the second anti-reflection layer 52, and the second anti-reflection layer 52 may be omitted in other embodiments, further details on the same are omitted herein for the sake of brevity.

In sum, the lamp of the disclosure employs LEDs to replace tungsten filament for a higher brightness. In addition, the presence of the heat-conducting pipe 25 accelerates the transmission of the waste heat, reduces temperature, and improves heat-dissipating efficiency. Moreover, the heat-dissipating unit 4 can be easily connected to or removed from the base seat 21 of the lamp base unit 2, so that the lamp can be installed in a general reflecting cover. Furthermore, the anti-reflection unit 5 further improves the quality of illumination.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A lamp comprising:

a lamp base unit including a base seat, a first seat that extends forwardly from said base seat, and a second seat that extends forwardly from said first seat;

a light emitting unit including an LED high beam light module that is disposed on one of said first seat and said second seat, and an LED low beam light module that is disposed on the other one of said first seat and said second seat, and that has a light irradiation direction different from that of said LED high beam light module;

a light shape piece disposed on the other one of said first seat and said second seat for refracting light that is emitted from a corresponding one of said LED high beam light module and said LED low beam light module to form a light shape having a cut-off line;

wherein, said first seat has a first mounting surface, and a first heat-dissipating surface opposite to said mounting surface;

said second seat has a second mounting surface having an orientation that is different from that of said first mounting surface, and a second heat-dissipating surface opposite to said second mounting surface;

said LED high beam light module is mounted on one of said first mounting surface and said second mounting surface, and said LED low beam light module is mounted on the other one of said first mounting surface and said second mounting surface; and wherein, said light shape piece is disposed on a lateral end of said second mounting surface of said second seat, said LED high beam light module being mounted on said first mounting surface of said first seat, said LED low beam light module being mounted on said second mounting surface of said second seat.

2. A lamp comprising:

a lamp base unit including a base seat, a first seat that extends forwardly from said base seat, and a second seat that extends forwardly from said first seat;

a light emitting unit including an LED high beam light module that is disposed on one of said first seat and said second seat, and an LED low beam light module that is disposed on the other one of said first seat and said second seat, and that has a light irradiation direction different from that of said LED high beam light module;

a light shape piece disposed on the other one of said first seat and said second seat for refracting light that is emitted from a corresponding one of said LED high beam light module and said LED low beam light module to form a light shape having a cut-off line; and wherein said lamp base unit further includes a heat-conducting pipe extending from said base seat to said second seat through said first seat.

3. A lamp comprising:

a lamp base unit including a base seat, a first seat that extends forwardly from said base seat, and a second seat that extends forwardly from said first seat;

a light emitting unit including an LED high beam light module that is disposed on one of said first seat and said second seat, and an LED low beam light module that is disposed on the other one of said first seat and said second seat, and that has a light irradiation direction different from that of said LED high beam light module;

a light shape piece disposed on the other one of said first seat and said second seat for refracting light that is emitted from a corresponding one of said LED high beam light module and said LED low beam light module to form a light shape having a cut-off line;

a heat-dissipating unit removably connected to said base seat of said lamp base unit, and having a plurality of spaced-apart heat-dissipating fins; and an anti-reflection unit having a first anti-reflection layer that is coated on an outer surface of said lamp base unit, and a second anti-reflection layer that is coated on an outer surface of said heat-dissipating unit.

* * * * *